US007190333B2

(12) United States Patent
Doyen et al.

(10) Patent No.: US 7,190,333 B2
(45) Date of Patent: Mar. 13, 2007

(54) VIDEO CODING METHOD AND SYSTEM FOR A PLASMA DISPLAY PANEL

(75) Inventors: Didier Doyen, La Bouexière (FR); Sébastien Weitbruch, Mönchweiler (DE); Cédric Thebault, Villingen-Schwenningen (DE); Carlos Correa, Villingen-Schwenningen (DE)

(73) Assignee: Thomson Licensing LLC., Boulonge-Billancourt (FR)

( * ) Notice: Subject to any disclaimer, the term of this patent is extended or adjusted under 35 U.S.C. 154(b) by 429 days.

(21) Appl. No.: 10/665,853

(22) Filed: Sep. 18, 2003

(65) Prior Publication Data

US 2005/0248505 A1 Nov. 10, 2005

(30) Foreign Application Priority Data

Sep. 20, 2002 (FR) ..... 02 11662

(51) Int. Cl.
*G09G 3/28* (2006.01)

(52) U.S. Cl. ..... 345/60; 345/61; 345/63; 345/65

(58) Field of Classification Search ..... 345/60–68, 345/41

See application file for complete search history.

(56) References Cited

U.S. PATENT DOCUMENTS 5,841,413 A * 11/1998 Zhu et al. ..... 345/63
6,201,519 B1 * 3/2001 Chevet et al. ..... 345/63
6,292,159 B1 9/2001 Someya et al. ..... 345/60
6,370,275 B1 * 4/2002 Benoit et al. ..... 382/237
6,473,464 B1 * 10/2002 Weitbruch et al. ..... 375/240.26

FOREIGN PATENT DOCUMENTS

EP 0945846 A1 2/1999
EP 01250158 * 3/2002

OTHER PUBLICATIONS

French Search Report.

* cited by examiner

*Primary Examiner*—Amr A. Awad
*Assistant Examiner*—Sameer Gokhale
(74) *Attorney, Agent, or Firm*—Joseph J. Laks; Harvey D. Fried; Sammy S. Henig

(57) ABSTRACT

The present invention relates to a coding method intended to improve the performance of GCC coding based on the temporal centre of gravity of displayed video codes. According to the invention, the number of video levels that can be selected in order to implement the GCC coding is increased by increasing the number of subfields in the video level display frame. This increase in the number of subfields is made possible by simultaneously addressing the cells of at least two adjacent rows of the PDP during at least two subfields of the video image display frame.

5 Claims, 11 Drawing Sheets

VIDEO CODING METHOD AND SYSTEM FOR A PLASMA DISPLAY PANEL

This application claims the benefit under 35 U.S.C. § 119 of which claims the benefit of French Application No. 02/11662 filed Sep. 20, 2002,

FIELD OF THE INVENTION

The present invention relates to a video coding method allowing the effects of false contouring in plasma display panels to be corrected. The invention relates more particularly to panels of the type with separate addressing and displaying.

BACKGROUND OF THE INVENTION

The technology of plasma display panels (PDPs) allows large flat display screens to be produced. PDPs generally comprise two insulating plates defining between them a gas-filled space in which elementary spaces bounded by barrier ribs are defined. One of the two plates is provided with an array of row electrodes and the other is provided with an array of column electrodes. An elementary cell corresponds to an elementary space provided with at least a row electrode and a column electrode that are placed on either side of the said elementary space. To activate an elementary cell, an electrical discharge is generated in the corresponding elementary space by applying a voltage between the row and column electrodes of the cell. The electrical discharge then causes the emission of UV radiation in the elementary cell. Phosphors deposited on the walls of the cell convert the UV into visible light. The cell will be red, green or blue depending on the nature of the phosphor deposited on its walls.

Unlike cathode-ray tube or liquid-crystal screens in which the video levels are obtained by modulating the amplitude of the voltage signal applied to the electrodes of the cell, a PDP controls the video levels by modulating the duration of ignition or the on time of the cells during a video frame, that is to say the gas contained in the cell is excited for a longer or shorter time depending on the desired grey level. The human eye then performs a time integration in order to recreate the grey level.

Consequently, the cells of the PDP have only two states: the on (excited) state or the off (unexcited) state. The cell is maintained in one of these states by the sending of a succession of pulses called sustain pulses over the desired duration of ignition. The cell is addressed by the sending of a higher electrical pulse, usually called an address pulse. Extinction, or erasure, of the cell is accomplished by eliminating the charges inside the cell using a damped discharge.

The various grey levels are obtained by modulating the duration of the successive on and off states of the cell over the course of the video frame. The frame is divided into periods called subfields during each of which the cell may either be on or off. The human eye integrates the periods of illumination of the cell in order to recreate the desired grey level.

FIG. 1 shows a conventional organization of the subfields within the video frame. The duration T of the video frame is 16.6 or 20 ms depending on the country. A minimum of eight subfields, denoted SF1 to SF8, is provided in the frame in order to display an image with 256 possible grey levels. Each of the subfields is used to turn on, or not, the cell for an illumination period of duration $T_{il}$ that is a multiple of an elementary duration $T_0$. Each subfield comprises for this purpose an address period of duration $T_{ad}$ and an illumination period (hatched in the figure) of specific duration $T_{il}$. The duration $T_{ad}$ is identical for all the subfields and is equal to $N_l \times T_{ae}$, where $N_l$ is the number of lines in an image and $T_{ae}$ is the line address time. On the other hand, the duration $T_{il}$ is specific to each subfield and is equal to $p \times T_0$ where p is an integer denoting the weight of the subfield in question. In the example shown in FIG. 1, the subfields SF1, SF2, SF3, SF4, SF5, SF6, SF7 and SF8 have 1, 2, 4, 8, 16, 32, 64 and 128 as respective weights. Thus, the video level of each colour component (R or G or B) will be represented by an 8-bit word, each bit being associated with one subfield of the frame. Of course, other organizations of subfields having a larger number of subfields or subfields with different weights may be employed.

Although this PDP technology offers the possibility of producing large screens of small thickness, it does have, however, drawbacks that degrade the quality of the image displayed. These drawbacks are associated with the time integration of the illumination periods over the course of the video frame. A problem of false contouring appears, especially when a point on the screen moves during several consecutive images. This defect is manifested in the image by the appearance of darker or lighter bands at grey level transitions that normally are barely perceptible.

This false contouring problem is illustrated in FIG. 2 which shows the subfields for two consecutive frames, F and F+1, having a transition between a 127 grey level and a 128 grey level. This transition moves by four pixels between the two frames. In the figure, the y-axis represents the time axis and the x-axis represents the pixels of the images that are displayed during the said frames. Integration carried out by the eye amounts to integrating over time along the oblique lines shown in the figure, as the eye has a tendency to follow the transition that moves. The eye therefore integrates the information coming from different pixels. The result of the integration gives the appearance of a grey level equal to zero at the moment of transition between the 127 and 128 grey levels. This passing through the zero grey level produces a dark band at the transition. In the reverse case, if the transition passes from the 128 level to the 127 level, a 255 level corresponding to a light band appears at the moment of the transition.

A first known solution for correcting this defect consists in "breaking" the high weights of the subfields in order to reduce the integration error. FIG. 3 shows the same transition as in FIG. 2, but with seven subfields of weight 32 instead of three subfields of weights 32, 64 and 128. The integration error is then at most a grey level value of 32. It is also possible to distribute the grey levels differently, however there still remains an integration error.

In European Patent Application No. 0 978 817, the false contouring effects are compensated for by using a movement estimator that determines movement vectors for blocks of pixels of the image. These movement vectors are used to modify the data delivered to the elementary cells of the PDP. The basic idea of that patent application is to detect the movements of the eye during the display of the images and to deliver movement-compensated data to the cells so that the eye integrates the correct information. This method is illustrated in FIG. 4. Such a correction amounts to displacing the subfields spatially according to the observed movements between the images so as to anticipate the integration that the human eye will perform. The subfields are displaced differently according to their weight and to their temporal position in the video frame. This solution requires a movement estimator that calculates a movement vector for each pixel or each block of pixels of the image. For each pixel, the corresponding movement vector is used to shift the associated code word in the direction of the movement vector. The code words for the pixels of the image are therefore recomputed. This solution gives good results at the transitions that cause false contouring effects but does require the implementation of a movement estimator having a high computing speed. This estimator is relatively expensive and not very easy to produce.

Another solution for compensating for the false contouring effects is based on a novel type of coding called "incremental coding". This method of coding is described for example in European Patent Application EP-A 952 569. In this method, only a small number of code words are used to display the image on the screen. The codes used have the feature of not including an "off" (respectively "on") subfield between two "on" (respectively "off") subfields. This feature makes it possible to completely eliminate the false contouring effects, but it does greatly limit, however, the number of codes that can be used (n+1 possible codes for a frame with n subfields). The grey levels corresponding to the other codes (that cannot be used) are reconstructed on the screen by error diffusion or "dithering" techniques well known to those skilled in the art. The major drawback of this coding is the small number of grey levels that can be displayed on the screen, the dithering techniques not always allowing the lost grey levels of the image to be restored.

Finally, there is a last solution, also employing a novel coding and introducing less dithering noise. This solution is described in the European Patent Application filed on 8 May 2001, the filing number of which is 01250158.1. This novel coding consists in selecting m video levels from the p video levels that can be displayed with a frame structure having n subfields, where n<m<p. The m video levels are selected so that the temporal centre of gravity of the illumination generated by their code words increases continuously with the video levels, except for the low video levels down to a first predefined limit value and/or for the high video levels from a second predefined limit value. This means that, for two levels GL1 and GL2 that belong to the m selected levels such that GL1>GL2, then the temporal centre of gravity of the code word associated with the level GL1 is higher than that of the code word associated with the level GL2.

The temporal centre of gravity of the illumination generated by a code word is calculated from the following formula:

$$CG(\text{code}) = \frac{\sum_{i=1}^{n} W(S_i)\cdot d_i(\text{code})\cdot CG(SF_i)}{\sum_{i=1}^{n} W(SF_i)\cdot d_i(\text{code})}$$

where:

CG(code) is the centre of gravity of the code word in question;

$W(SF_i)$ denotes the weight of the ith subfield ($SF_i$) of the frame;

$d_i$(code) is equal to 1 if the ith subfield is on for the code in question, and 0 otherwise; and $CG(SF_i)$ is the centre of gravity of the ith subfield.

The centre of gravity of the $i^{th}$ subfield, $CG(SF_i)$, is calculated in the following manner:

$$CG(SF_i)=D(SF_i)+\text{Dur}(SF_i)/2$$

where:

$D(SF_i)$ is the time start point of the ith subfield; and $\text{Dur}(SF_i)$ is the duration of the ith subfield.

With this coding, which hereafter will be called GCC (Gravity Centre Coding), the curve showing the centres of gravity of the codes selected as a function of the video levels is monotonic, at the very least between the said first and second predefined limit values, thereby making it possible to eliminate the false contouring effects. Moreover, the number of video levels that can be displayed with this coding is larger than with an incremental coding, thereby allowing the dithering noise to be reduced.

The GCC coding is illustrated in FIGS. 5 to 7. FIG. 5 shows the temporal centres of gravity of all the video words that are possible with a frame structure comprising eleven subfields, the weights of which are as follows:

1-2-4-7-11-16-23-32-43-56-60.

The y-axis represents the centre-of-gravity value and the x-axis represents the video level of the code word. Since there are eleven subfields, there are $2^{11}$, i.e. 2048, possible code combinations for the 256 video levels. Corresponding to each video level is therefore one or more code words and therefore one or more centres of gravity. The centre of gravity is calculated from the formulae indicated above. For this calculation, an overall time of 1 ms for addressing and erasing each subfield and a maximum illumination time $T_{max}$ of 5.10 ms (corresponding to the sum of the illumination periods of all the subfields of the frame) were considered, which gives an illumination time of 0.02 ms for the subfield of weight 1, an illumination time of 0.04 ms for the subfield of weight 2, . . . , and an illumination time of 1.2 ms for the subfield of weight 60. The corresponding frame then has a duration of 16.1 ms, which corresponds to a frequency of 60 Hz.

FIG. 6 shows the lowest centre-of-gravity value for each video level. This is because it is general to use, in order to code a video level, the video word having the lowest centre of gravity, as it is this one that introduces the fewest false contouring effects because the subfields of lower weight are used. As may be seen, the curve defined by these values is not monotonic, rather it has jumps that inevitably introduce false contouring effects.

GCC coding aims to eliminate these false contouring effects by selecting only a restricted number of video levels, as shown in FIG. 7, so as to obtain a monotonic centre-of-gravity curve. The video levels selected are identified in the figure by a small black diamond.

As may be seen in this figure, the number of levels that meet the GCC coding may be relatively small. The number of video levels selected is therefore small and means that there is always dithering noise when displaying a video image.

The main object of the invention is to alleviate the aforementioned drawback.

SUMMARY OF THE INVENTION

According to the invention, it is proposed to increase the number of subfields in the frame without degrading the maximum illumination time $T_{max}$ of the cells of the PDP so as to increase the number of possible codes for each video level. Thus, the number of video levels that can be selected for implementing the GCC coding is increased.

According to the invention, this increase in the number of subfields is made possible by simultaneously addressing the cells of at least two adjacent lines of the PDP during at least two subfields of the video image display frame.

Thus, the invention is a method of coding a video image displayed on a plasma display panel comprising a plurality of cells arranged in rows and columns, the video levels of the pixels of the image being defined by n-bit video words, each bit, depending on its state, illuminating or not illuminating the cell to which it is addressed for a specific time called the subfield.

For video levels GL1 and GL2 to be displayed by a pair of cells (C1, C2) situated in the same column and in two adjacent rows of the panel, video words VW1 and VW2 are selected, the said words comprising at least one common bit addressed simultaneously to the two cells at the moment of displaying the image and corresponding to levels equal or approximately equal to the video levels GL1 and GL2 such that, if GL1>GL2, then the temporal centre of gravity of the illumination generated by the video word VW1 is greater than that generated by the video word VW2.

The video words VW1 and VW2 selected preferably comprise k common bits, each common bit being simultaneously addressed to the two cells of the pair during what is called a common subfield of the video frame, k being greater than 1.

According to a first embodiment, to select the video words VW1 and VW2, the following steps are carried out:

(a) a set of p video words whose temporal centre of gravity increases continuously as the corresponding video level increases is defined;

(b) the video words whose corresponding video levels GL1' and GL2' are equal or approximately equal to the video levels GL1 and GL2, respectively, are determined from the said p video words;

(c) one or other of the video words determined in step (b) is selected; and (d) the video word whose temporal centre of gravity and video level are closest to those of the video word not selected in step (c) are selected from all the possible video words having bits with the same value as the video word selected for the common subfields.

According to a second embodiment, in order to select the video words VW1 and VW2, the following steps are carried out:

(a) a set of p video words whose temporal centre of gravity increases continuously as the corresponding video level increases is defined;

(b) the pair of video words whose corresponding video levels GL1' and GL2' are equal or approximately equal to the video levels GL1 and GL2, respectively, are determined from the said p video words; and (c) the pair of video words whose temporal centres of gravity and video levels are closest to those of the pair of video words determined in step (b) is selected from all the possible video words having bits with the same value as the video word selected for the common subfields.

The invention also relates to a system for implementing the coding method of the invention.

BRIEF DESCRIPTION OF THE DRAWINGS

The abovementioned features and advantages of the invention, as well as others, will become more clearly apparent on reading the following description in conjunction with the appended drawings, in which.

DESCRIPTION OF PREFERRED EMBODIMENTS

According to the invention, it is envisaged to increase the number of subfields in the frame in order to improve the performance of the GCC coding and more particularly to improve the selection (in terms of number and value) of the video levels that will be used to display the images. For example, the number of subfields is increased from eleven (2048 possible code words) as described previously to fourteen (16384 possible code words).

For example, a frame structure comprising 14 subfields is defined, the weights of which are the following:

1-2-4-5-8-10-16-20-20-29-30-30-40-40.

Figure 1:
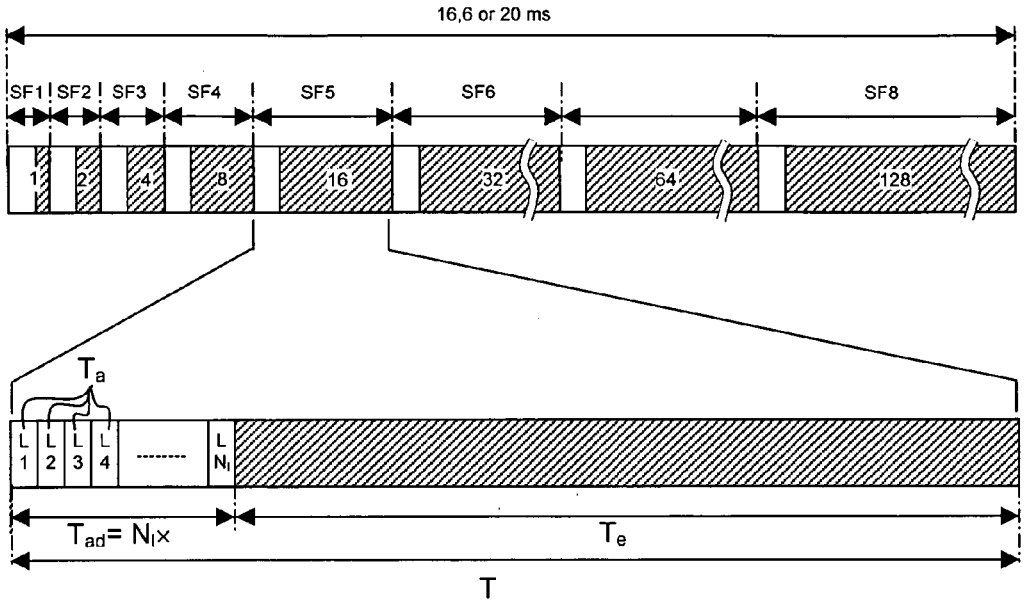
FIG. 1 shows the subfields forming the display frame for a video image in a PDP.
Figure 2:
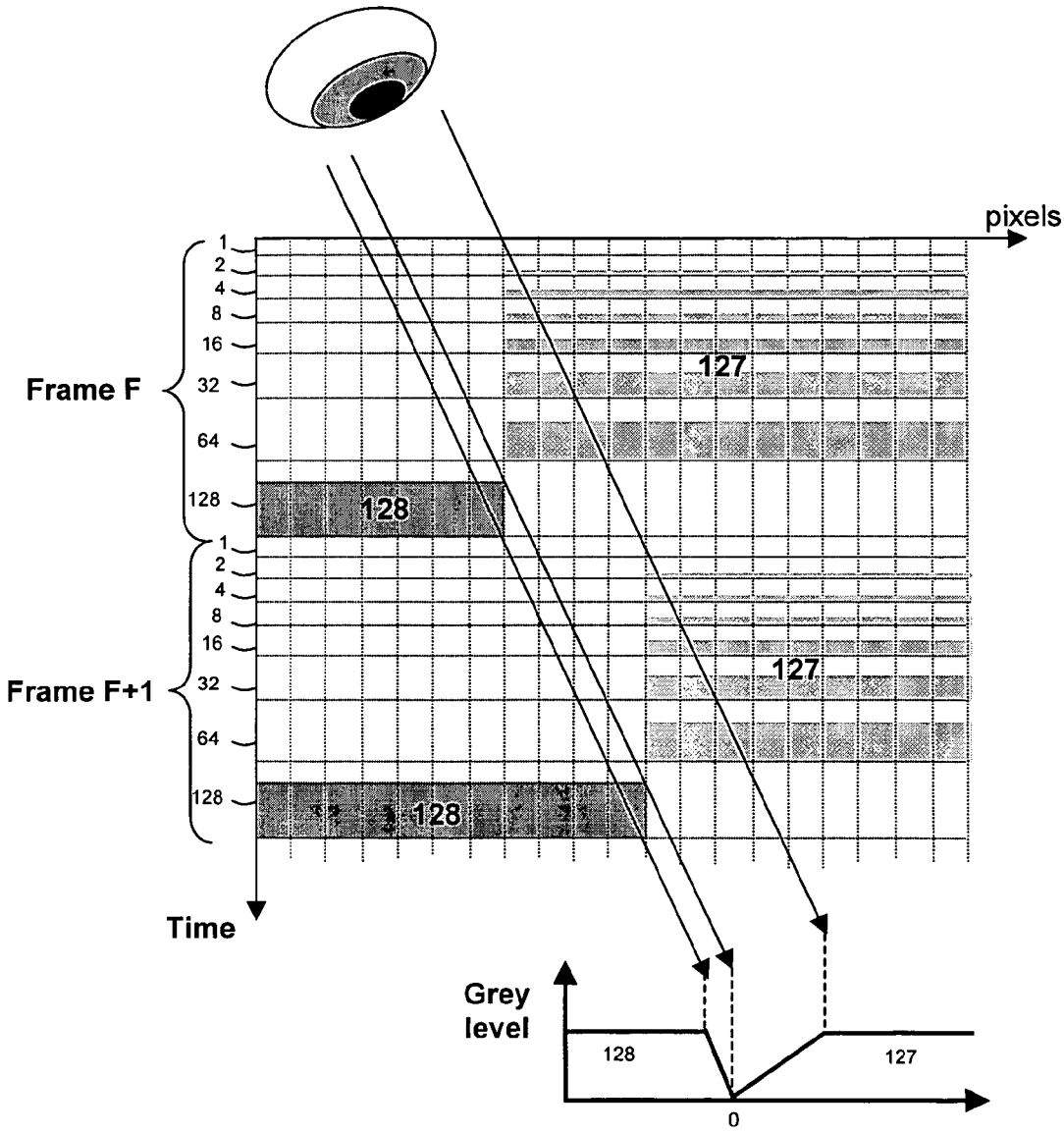
FIG. 2 illustrates the false contouring effects during display of the video images on the PDP.
Figure 3:
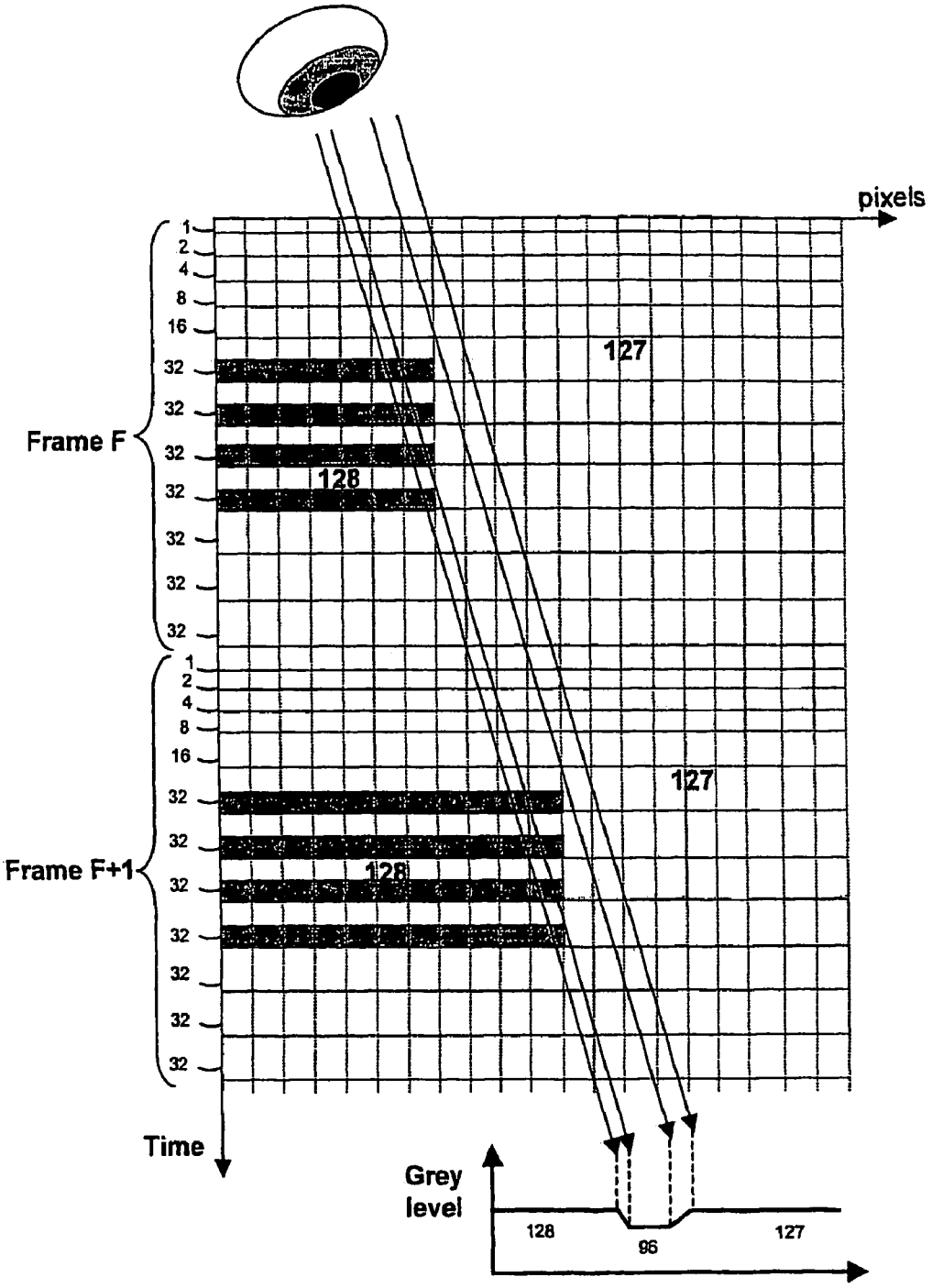
FIG.3 PRIOR ART
FIGS. 3 and 4 illustrate first and second known solutions for limiting the false contouring effects.
Figure 4:
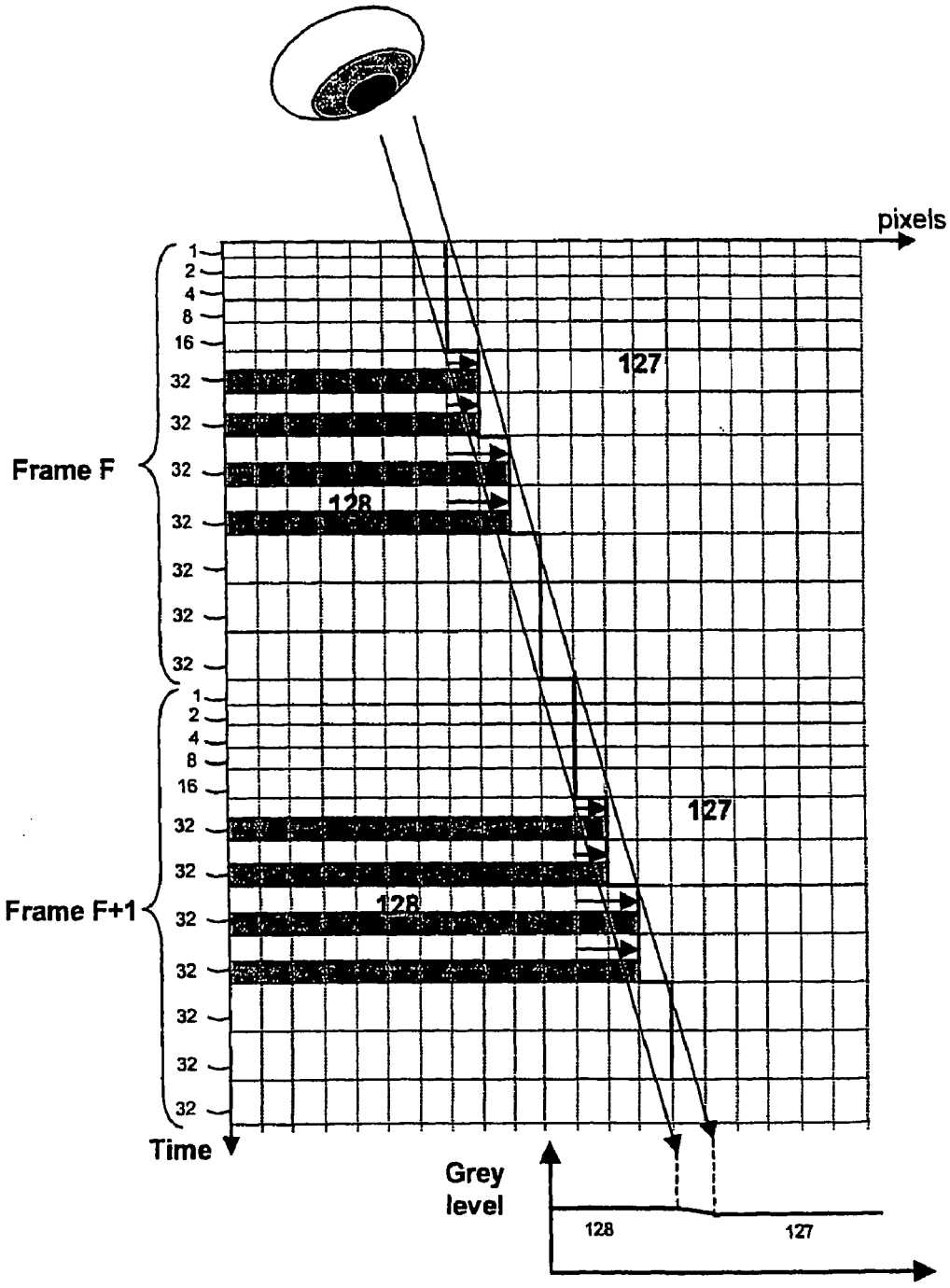
FIG.4 PRIOR ART
Figure 5:
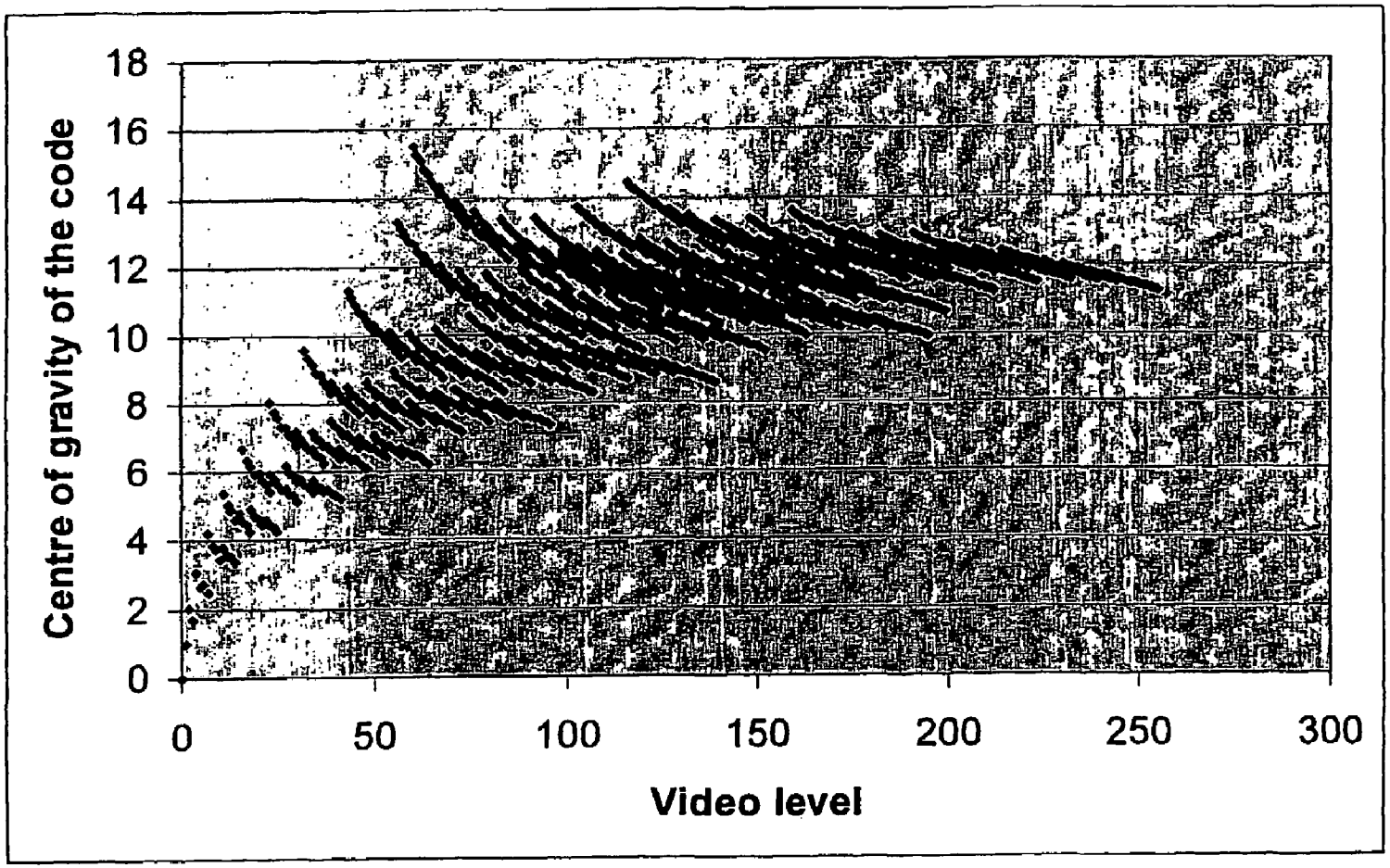
FIG.5 PRIOR ART
FIGS. 5 to 7 illustrate a third known solution called GCC coding.
Figure 6:
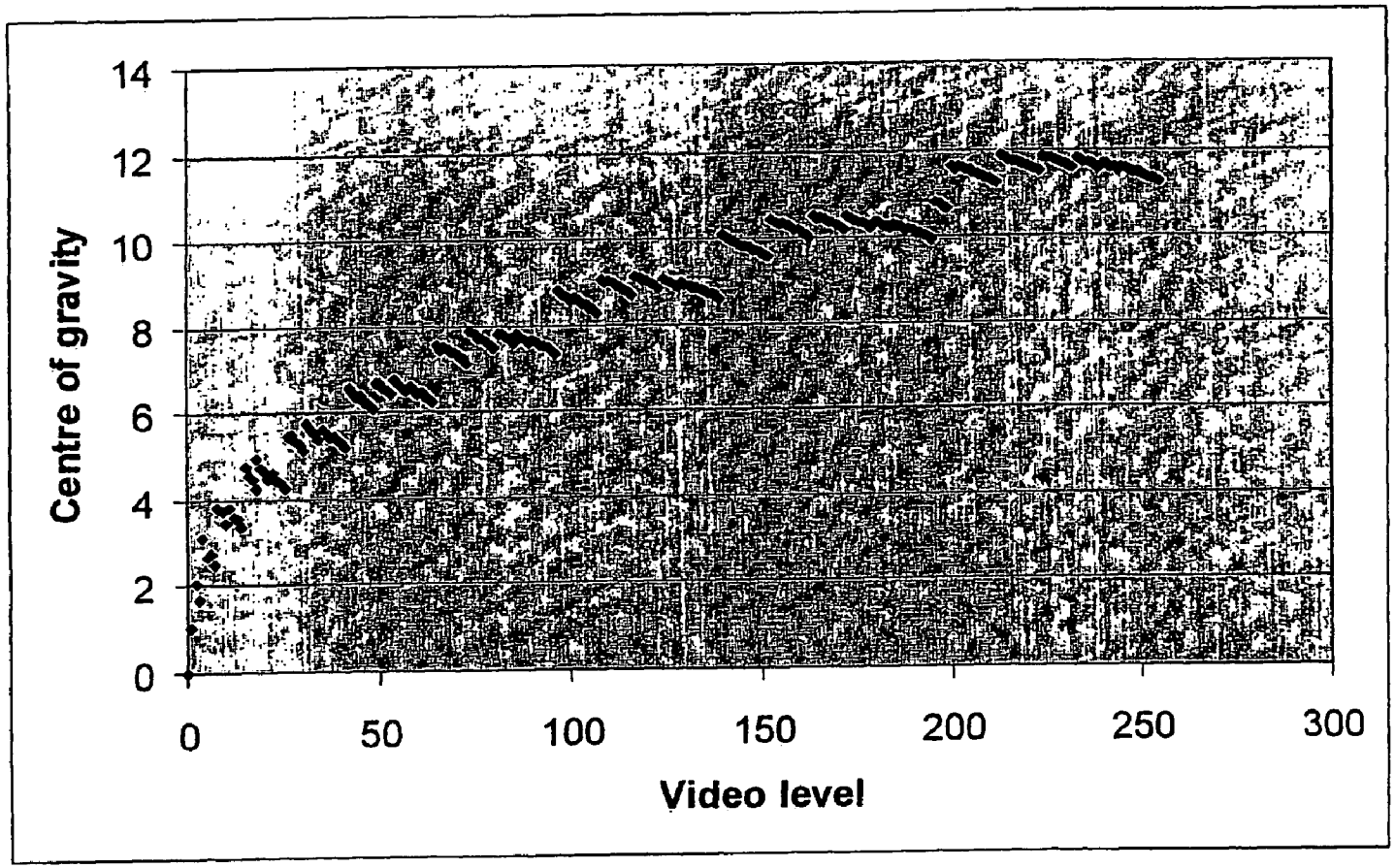
FIG.6 PRIOR ART
Figure 7:
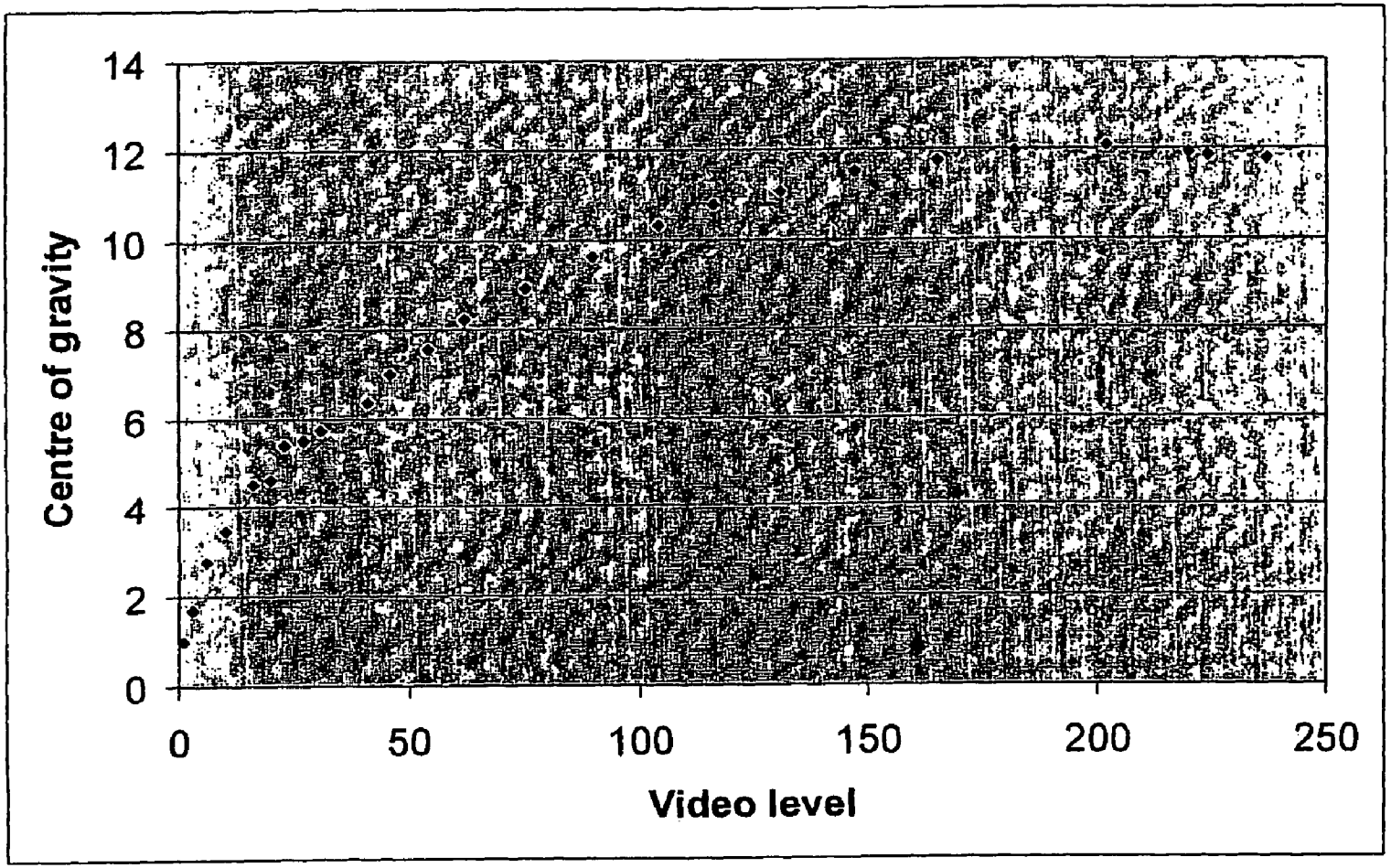
FIG.7 PRIOR ART
Figure 8:
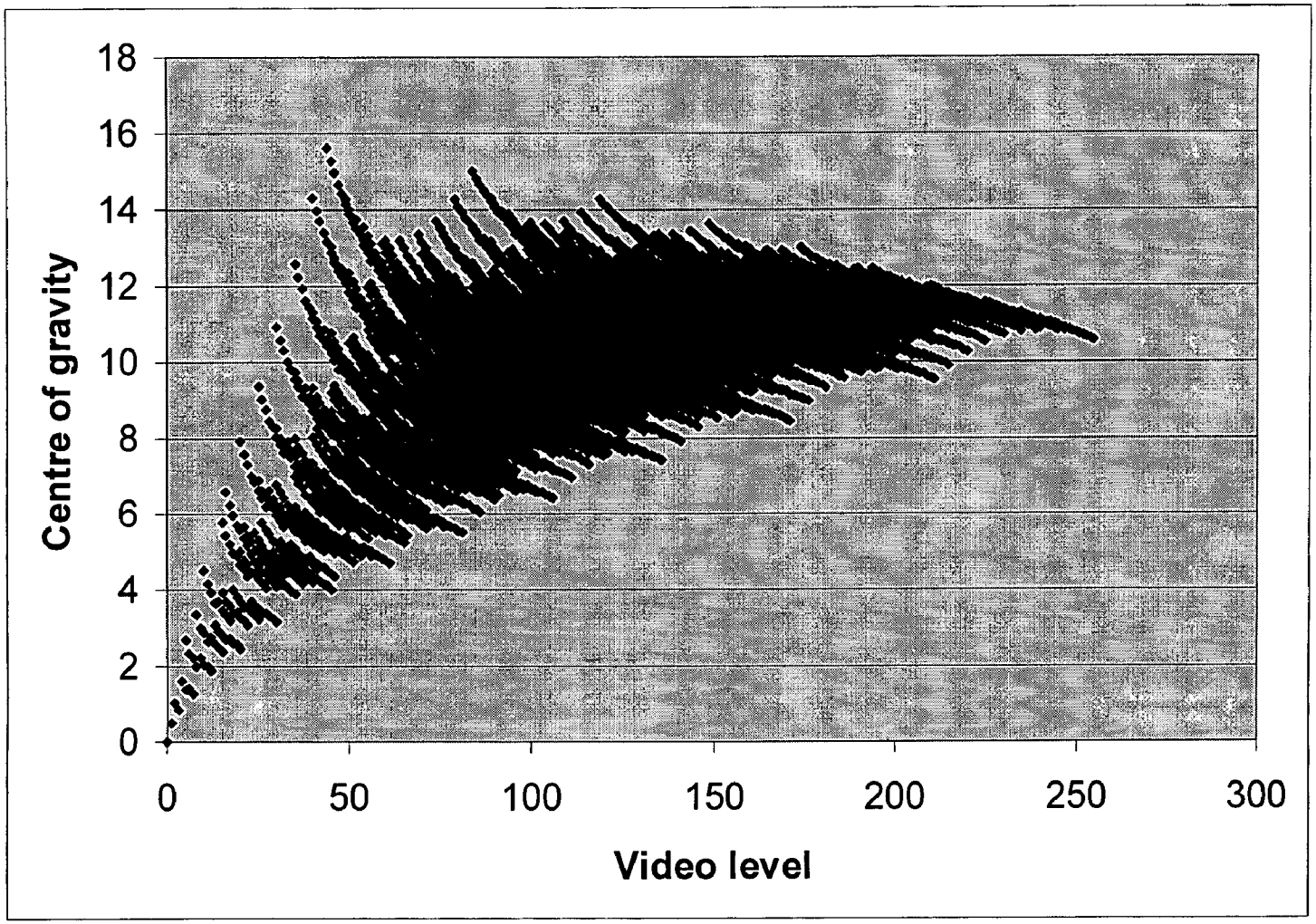
FIG. 8 shows the temporal centre of gravity of the 16384 video words that are possible with a 14-subfield frame structure as a function of the corresponding video levels.

This structure allows the use of 16384 possible code words instead of 2048 with the previous structure comprising 11 subfields. The number of code words possible for each video level is substantially increased thereby. FIG. 8 shows the centres of gravity of these 16384 code words.

To give an example, there are now eight video words for the video level 25, instead of previously three. The video words are represented hereafter in the form of a sum of values, each value corresponding to the activation of the subfield having a weight equal to the said value.

With the 11-subfield structure, the video words for coding the video level 25 were:

25=1+2+4+7+11 or 2+7+16 or 2+23.

The video level 25 can now be coded according to one of the following combinations:

25=1+2+4+8+10 or 2+5+8+10 or 1+8+16 or 4+5+16 or 1+4+20(1)

or 1+4+20(2)

or 5+20(1)

or 5+20(2).

20(1) and 20(2) denote the weights of the first and second subfields of weight 20, respectively.

The number of possible video words is thus increased, for most of the video levels.

To implement the GCC coding, a certain number of words meeting the GCC coding criterion, that is to say that the temporal centre of gravity of the video words selected must increase as the corresponding video level increases, except for the high video levels in which the temporal centre of gravity of the codes selected decreases slightly, are selected from all these possible video words.

Figure 9:
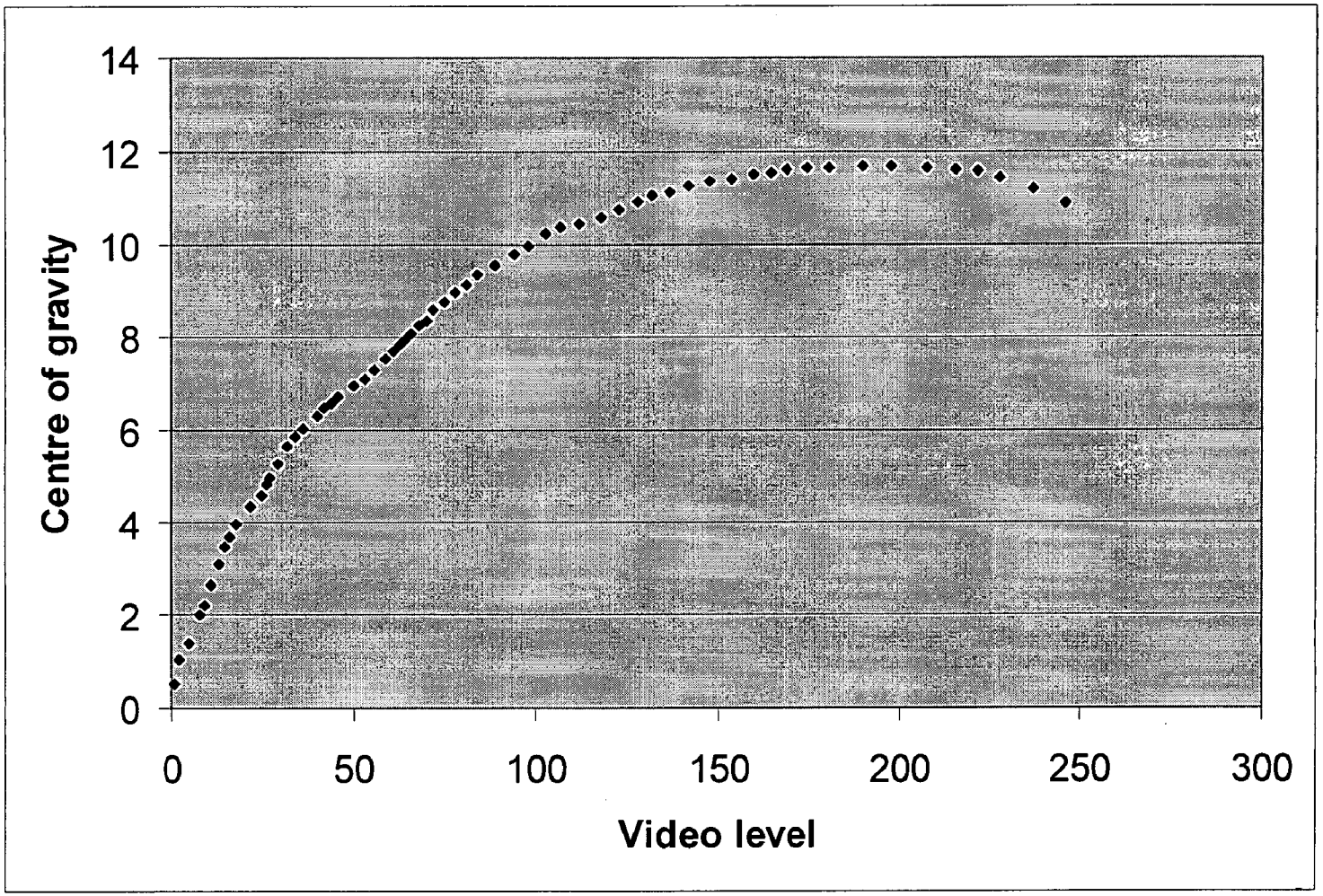
FIG. 9 illustrates the video words selected according to the invention with a 14-subfield structure.

FIG. 9 shows an example of selection. Given that the number of video words is much larger than previously, it is possible to select a larger number of video levels. This increased number of displayable video levels will contribute to reducing the dithering noise during image display. In the example shown in FIG. 9, 64 video words corresponding to 64 video levels were selected.

To obtain fourteen subfields instead of eleven without increasing the duration of the frame, nor reducing the maximum illumination time $T_{max}$, the solution consists in simultaneously addressing two adjacent lines of the PDP over six subfields of the frame. This technique is usually called "bit line repeat" in the literature. The address time for these six subfields is divided by two, which corresponds to addressing of three subfields. In the rest of the description, the subfields during which two adjacent lines of cells of the PDP are addressed simultaneously will be called common subfields. The other subfields will be called specific subfields.

In practice, it is necessary instead to provide seven or eight common subfields since adding three additional subfields means also adding three additional erase periods. The use of a larger number of subfields furthermore makes it possible to save time in respect of the illumination and therefore to increase the brightness of the panel.

The combination of the GCC coding technique and the bit line repeat technique does require, however, particular processing before the image is displayed, as they are not always a priori compatible.

This incompatibility and this processing will be described through the example of an application that follows. For this example, we will consider that the subfields whose weights are underlined are specific subfields and that the others are common subfields:

1-2-4-5-8-10-16-20-20-29-30-30-40-40.

According to the principle of GCC coding, a set of video words is selected. This set comprises, among others, for example the grey levels 38-44-50-57-65 having the following codes and temporal centre-of-gravity values:

38=4+8+10+16 $CG(38)=4.28$

44=1+2+5+16+20 $CG(44)=5.28$

50=4+10+16+20 $CG(50)=5.71$

57=1+10+16+30 $CG(57)=7.59$

65=5+10+20+30 $CG(65)=7.87$

The aim is to code the grey levels 42 and 60, these two grey levels relating to adjacent cells belonging to consecutive lines of the PDP.

The closest values allowed by the GCC coding are, in this example, the values 44 and 57. This coding does not take into account the fact that certain subfields are common and that others are specific.

The common and specific subfields of the frame do not allow the grey levels 44 and 57 with the codes adopted by GCC coding to be displayed simultaneously. Nor is it possible to display the grey levels 42 and 60. At best, it is possible to display the values 41 and 61 with the following codes:

41=1+2+4+8+10+16

61=1+2+4+8+10+16+20.

Several solutions have been envisaged to solve this incompatibility problem.

First Solution:

Starting, for example, with the code word of value 44, the aim is to find a code that respects the communing of subfields in the frame and has a value close to 57. Thus the value 59 is found with three possible codes, namely:

44=1+2+5+16+20

59=1+2+10+16+30 $CG(59)=7.36$ or =1+2+16+40(1) $CG(59)=10.21$ or =1+2+16+40(2) $CG(59)=11.43$.

40(1) and 40(2) denote the weights of the first and second common subfields of weight 40, respectively. The code of value 59 having the temporal centre of gravity closest to that of the value 57, that is to say the code 1+2+10+16+30, is selected.

Second Solution:

The procedure starts this time with the codes of values 41 and 61 that respect the communing of subfields in the frame, that is to say:

the codes indicated above:

41=1+2+4+8+10+16 $CG(41)=4.03$

61=1+2+4+8+10+16+20 $CG(61)=4.88$ but also

41=1+4+16+20 $CG(41)=5.88$

61=1+4+16+20+20 $CG(61)=6.12$ or else

41=2+5+8+10+16 $CG(41)=4.19$

61=2+5+8+10+16+20 $CG(61)=4.98$ or else

41=5+16+20 $CG(41)=6.04$

61=5+16+20+20 $CG(61)=6.23$

Finally, the pair of codes (41, 61), the temporal centres of gravity of which are as close as possible to those of the pair (44, 57), for example the pair whose sum of the temporal centres of gravity is as close as possible to that of the pair (44, 57), is chosen.

As a variant, this solution may be expanded and applied to pairs other than the pair (41, 61), for example the pairs (42, 62) or (40, 60), introducing a larger error in one or other or in both of the video levels of the pair compared with the pair (41, 61). The pair of video words whose distance from the centre-of-gravity curve is the shortest is therefore selected from all the possible pairs of video words. This solution is preferably applied when none of the pairs of video words associated with the pair (41, 31) meets the GCC coding criterion.

Very many structures are possible for implementing the method of the invention. Processing circuits employing the above solutions are shown in FIGS. 10 and 11.

Figure 10:
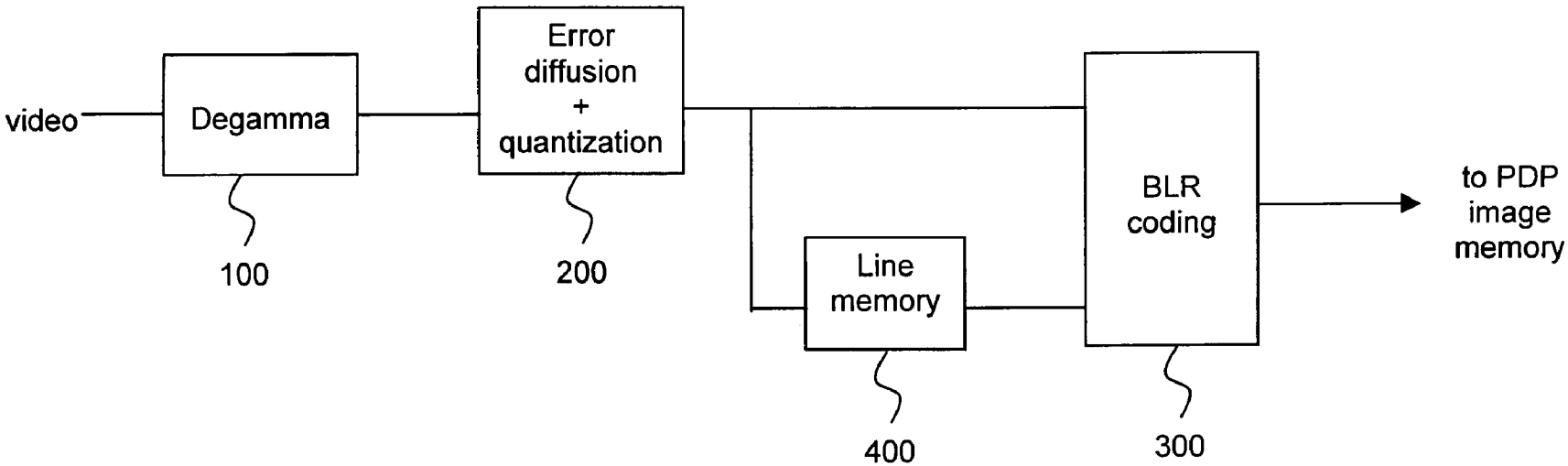
FIGS. 10 and 11 illustrate two circuits for implementing the method of the invention.

The system shown in FIG. 10 employs the first solution. In a first block 100, the video signal is corrected by an inverse gamma function. This is necessary since the PDP has an intensity response characteristic which is linear, unlike that of a television set with a cathode ray tube, which is quadratic. The purpose of this inverse gamma correction is to remove the gamma correction that is applied within the camera.

The video signal is then processed by an error diffusion and quantization block 200. The function of this block is to convert the video signal so that it comprises only a limited number of video levels, in accordance with the GCC coding. The video signal thus processed is then delivered to a coding block 300 responsible for carrying out the bit-line-repeat technique. This coding block has two inputs, the first input being, for example, intended to receive the codes for the odd lines of the image and the second input being intended to receive the codes for the even lines (in the case of the addressing of two adjacent lines simultaneously). In order for the adjacent lines of the image to be processed simultaneously in the coding block 300, a line memory 400 is provided in order to delay the odd lines of the image by one line. The function of the block 300 is to search for a code that has a video level and a temporal centre of gravity that are close to those of the code present at the first input of the block and that has the same bit values for the common subfields as the code present at the second input. This new code and the code present at the second input of the block are then delivered to the image memory of the PDP.

Figure 11:
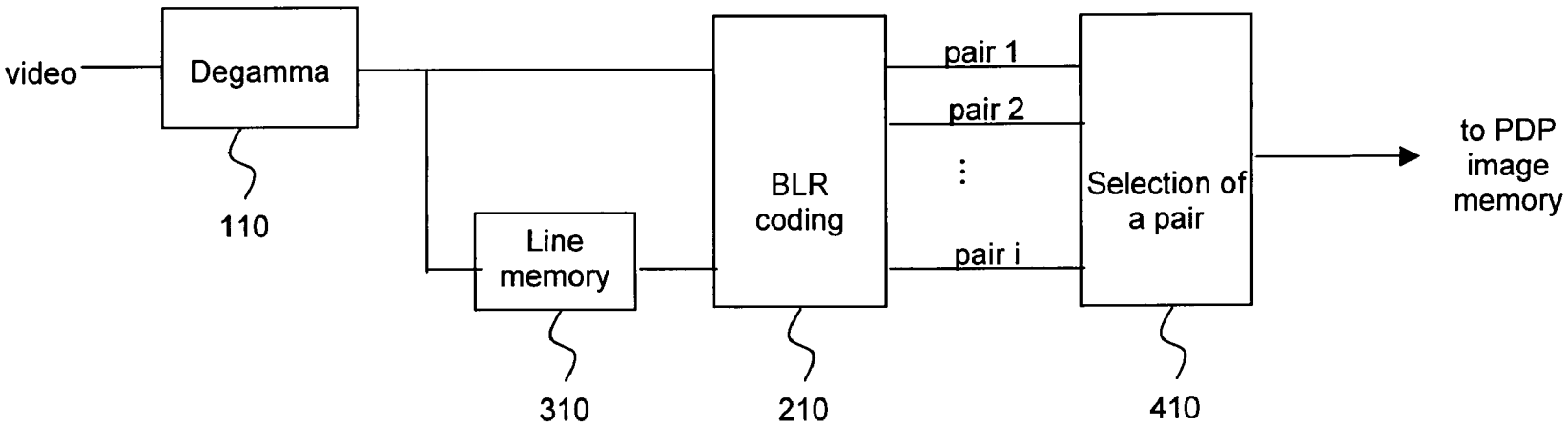

FIG. 11 shows a system that can implement the second solution described above. In this system, the video signal is firstly processed by a block 110 that makes an inverse gamma correction to the video signal. The corrected video signal is delivered to a coding block 210 responsible for implementing the bit-line-repeat technique. Like the block 300, this block has two inputs, the first input being, for example, intended to receive the odd lines of the image and the second input to receive the even lines (a case of the addressing of two adjacent lines simultaneously). The odd lines of the image are delayed by one line by a line memory 310. The block 210 determines, for each pair of video levels received, the pairs of video words having a close video level that respects the communing of certain subfields at the moment of image display. All these pairs are sent to a block 410 responsible for selecting, from among them, the pair of video words whose distance from a predefined monotonic centre-of-gravity curve is the shortest. The result is sent to the image memory of the PDP.

The circuit diagrams shown in FIGS. 10 and 11 are given merely by way of illustration and many alternative forms may be substituted therein.

What is claimed is:

1. A method of coding a video image displayed on a plasma display panel comprising a plurality of cells arranged in rows and columns, the video levels of the pixels of the image being defined by n-bit video words, each bit, depending on its state, illuminating or not illuminating the cell to which it is addressed for a specific time called the subfield, wherein, for video levels GL1 and GL2 to be displayed by a pair of cells situated in the same column and in two adjacent rows of the panel, video words VW1 and VW2 are selected, said words comprising at least one common bit addressed simultaneously to the two cells at the moment of displaying the image and corresponding to levels equal or approximately equal to the video levels GL1 and GL2 such that, if GL1>GL2, then the temporal centre of gravity of the illumination generated by the video word VW1 is greater than that generated by the video word VW2 below a predetermined video level.

2. The method according to claim 1, wherein the video words VW1 and VW2 selected comprise k common bits, each common bit being simultaneously addressed to the two cells of the pair during what is called a common subfield, k being greater than 1.

3. The method according to claim 2, wherein, to select the video words VW1 and VW2, the following steps are carried out:

(a) a set of p video words whose temporal centre of gravity increases continuously as the corresponding video level increases is defined;

(b) two video words whose corresponding video levels GL1' and GL2' are equal or approximately equal to the video levels GL1 and GL2, respectively, are determined from the said p video words;

(c) one or other of the two video words determined in step (b) is selected; and (d) the video word whose temporal centre of gravity and video level are closest to those of the video word not selected in step (c) is selected from all the possible video word having bits with the same value as the video words selected for the common subfields.

4. The method according to claim 2, wherein, in order to select the video words VW1 and VW2, the following steps are carried out:

(a) a set of p video words whose temporal centre of gravity increases continuously as the corresponding video level increases is defined;

(b) the pair of video words whose corresponding video levels GL1' and GL2' are equal or approximately equal to the video levels GL1 and GL2, respectively, are determined from the said p video words; and (c) the pair of video words whose temporal centres of gravity and video levels are closest to those of the pair of video words determined in step (b) is selected from all the possible video words having bits with the same value as the video word selected for the common subfields.

5. A system for coding a video image for a plasma display panel comprising:

a coding module responsive to a video signal for coding said video image to provide coded video image data at an output thereof, wherein a plurality of cells are arranged in rows and columns, and wherein the video levels of the pixels of the image are defined by n-bit video words, each bit, depending on its state, illuminating or not illuminating the cell to which it is addressed for a specific time called the subfield, wherein, for video levels GL1 and GL2 to be displayed by a pair of cells situated in the same column and in two adjacent rows of the panel, video words VW1 and VW2 are selected via said coding module, said words comprising at least one common bit addressed simultaneously to the two cells at the moment of displaying the image and corresponding to levels equal or approximately equal to the video levels GL1 and GL2 such that, if GL1>GL2, then the temporal centre of gravity of the illumination generated by the video word VW1 is greater than that generated by the video word VW2 below a predetermined video level.

* * * * *